US011629546B2

(12) United States Patent
Comunello

(10) Patent No.: US 11,629,546 B2
(45) Date of Patent: Apr. 18, 2023

(54) MOVEMENT SYSTEM FOR A CLOSURE STRUCTURE WITH FOLDING MOVEMENT

(71) Applicant: Fratelli Comunello S.P.A., Rosa (IT)

(72) Inventor: Franco Comunello, Rosa (IT)

(73) Assignee: FRATELLI COMUNELLO S.P.A., Rosa' (IT)

( * ) Notice: Subject to any disclaimer, the term of this patent is extended or adjusted under 35 U.S.C. 154(b) by 502 days.

(21) Appl. No.: 16/737,986

(22) Filed: Jan. 9, 2020

(65) Prior Publication Data

US 2020/0217114 A1 Jul. 9, 2020

(30) Foreign Application Priority Data

Jan. 9, 2019 (IT) ..... 102019000000301

(51) Int. Cl.

| | |
|---|---|
| ***E06B 3/48*** | (2006.01) |
| ***E05D 3/12*** | (2006.01) |
| ***E06B 11/02*** | (2006.01) |
| ***E05D 15/26*** | (2006.01) |

(52) U.S. Cl.

CPC ..... *E06B 3/481* (2013.01); *E05D 3/122* (2013.01); *E05D 15/264* (2013.01); *E06B 11/022* (2013.01)

(58) Field of Classification Search

CPC ... E05D 15/264; E05D 15/266; E06B 11/022; E06B 3/481

See application file for complete search history.

(56) References Cited

U.S. PATENT DOCUMENTS

| | | | | |
|---|---|---|---|---|
| 9,097,047 | B2 * | 8/2015 | Adriaansen | E05D 15/10 |
| 11,248,417 | B2 * | 2/2022 | Brinkman | E01F 13/06 |
| 2006/0169425 | A1 * | 8/2006 | Long | E05F 15/627 160/213 |
| 2011/0097138 | A1 * | 4/2011 | Eikelenboom | B64G 1/222 403/81 |
| 2013/0042531 | A1 * | 2/2013 | Hird, Jr. | E05F 15/627 219/121.72 |
| 2014/0259939 | A1 * | 9/2014 | Collinson | E05F 15/63 49/340 |

(Continued)

FOREIGN PATENT DOCUMENTS

| | | | | |
|---|---|---|---|---|
| CN | 103993796 | B | 3/2016 | |
| DE | 19809601 | A1 * | 9/1999 | E05B 65/0085 |

(Continued)

*Primary Examiner* — Marcus Menezes
(74) *Attorney, Agent, or Firm* — Mark M. Friedman

(57) ABSTRACT

Movement system for a closure structure with folding movement, comprising a transmission hinge which connects a first panel to a second panel of the closure structure. The transmission hinge has a first wing fixed to the first panel, a movement lever hinged to the first wing around a first axis, and a second wing which is hinged to the movement lever around a second axis and is fixed to the second panel. The movement system comprises a transmission mechanism which, following the rotation of the first panel, drives the movement lever to rotate around the first axis. The transmission hinge comprises a gear connecting the first wing to the second wing so that, following the rotation of the movement lever, the second wing is actuated by such gear to rotate around the second axis in order to make the second panel rotate with respect to the first panel.

11 Claims, 10 Drawing Sheets

(56) References Cited

U.S. PATENT DOCUMENTS

| | | | | |
|---|---|---|---|---|
| 2020/0217114 | A1* | 7/2020 | Comunello | E06B 3/481 |
| 2020/0291721 | A1* | 9/2020 | Brinkman | E06B 11/022 |
| 2021/0325937 | A1* | 10/2021 | Siddiqui | G06F 1/1683 |
| 2022/0090426 | A1* | 3/2022 | Gaunt | E05D 5/0223 |

FOREIGN PATENT DOCUMENTS

| | | | |
|---|---|---|---|
| DE | 202018005400 | U1 | 12/2018 |
| DE | 202018005400 | U1 * | 1/2019 |
| NL | 2014684 | B1 | 1/2017 |
| WO | WO-2016181358 | A1 * | 11/2016 |

* cited by examiner

MOVEMENT SYSTEM FOR A CLOSURE STRUCTURE WITH FOLDING MOVEMENT

FIELD OF APPLICATION

The present invention regards a movement system for a closure structure with folding movement.

The present movement system is advantageously inserted in the field of production of gates and accessories for gates, as well in the field of windows/shutters/doors and of accessories for windows/shutters/doors, and in general of movable structural elements employable for delimiting or closing a passage, such as a passage for vehicle or pedestrian access to a property, structure, company, building or garden, or a door or a window.

STATE OF THE ART

Gates having movement termed "folding" are known on the market; these comprise two or more panels hinged in succession. More in detail, such gate of known type comprises a first panel provided with a first constrained flank, which is hinged to a fixed structure placed at a side of the passage (e.g. a column or a low wall), and a first free flank connected to a second panel. The latter is provided with a second constrained flank, which is hinged to the first free flank of the first panel, and a second free flank intended to reach other other side of the passage.

Such gate is movable between a closed position, in which the two panels are extended aligned one after the other in a manner such to occupy the entire extension of the passage, and an open position, in which the two panels are folded one adjacent to the other outside of the passage bulk.

The gate comprises an actuation motor which acts on the first panel in order to make it rotate at least 90° during the movement of the gate between the closed position and the open position.

In addition, the gate comprises transmission means which transmit the rotation motion from the first panel—directly connected to the motor—to the second panel, in a manner such to move, in a coordinated manner, the two panels during the opening and closing of the gate. More in detail, such transmission means, during the movement of the gate, make the second panel rotate 180° with respect to the first panel, in order to move it from the closed position, in which the second panel is aligned with and parallel to the first panel, to the open position, in which the second panel is parallel to and side-by-side the first panel outside the bulk of the passage.

One example of a gate with folding movement of known type is described in the Italian patent No. 102015000088288. In such example, the transmission means, which determine the rotation of the second panel with respect to the first panel, comprise a toggle mechanism provided with a first lever having a constrained end connected to the first panel and a free end hinged to a second lever which is in turn rotatably constrained to the second panel of the gate. The mechanism also comprises a constraining lever placed to connect between the first panel and the second lever in order to constrain the movement of the second lever to the rotation of the first panel.

In addition, a connecting rod-crank mechanism is provided, connected to the constrained end of the first lever and adapted to make such constrained end slide along the first panel during the rotation of the latter, in a manner such to determine, by means of the second lever and the constraining lever, a corresponding rotation of the second panel of the gate.

This solution of known type nevertheless has several drawbacks.

One drawback of such solution of known type is due to the fact that it is structurally complex, in particular requiring the specific arrangement and sizing of numerous components in order to form the means for transmitting the motion from the first panel to the second panel.

PRESENTATION OF THE INVENTION

In this situation, the problem underlying the present invention is therefore that of eliminating the drawbacks of the prior art known up to now, by providing a movement system for a barrier with folding movement, which is structurally simple and inexpensive to make.

A further object of the present invention is to provide a movement system for a barrier with folding movement that is simple and quick to install.

A further object of the present invention is to provide a movement system for a barrier with folding movement that is entirely safe and reliable in operation.

BRIEF DESCRIPTION OF THE DRAWINGS

The technical characteristics of the invention, according to the aforesaid objects, are clearly visible in the contents of the below-reported claims and the advantages thereof will be more evident in the following detailed description, made with reference to the enclosed drawings, which represent a merely exemplifying and non-limiting embodiment of the invention, in which:

DETAILED DESCRIPTION OF A PREFERRED EMBODIMENT

With reference to the enclosed drawings, reference number 1 overall indicates an example of a movement system for a closure structure 100 (such as a gate, door or window) with folding movement, object of the present invention.

In general, with the term closure structure 100 it must be intended, without departing from the protective scope of the present patent, any one barrier, such as a main door or gate, or a fixture of a door or of a window, susceptible of moving between two provided open and closed positions in order to carry out the function of opening or closing a passage A, such as the access to a property, to a structure or a building, or an opening of a building such as a door or a window.

In accordance with the example illustrated in the enclosed figures, the closure structure 100 is represented by a gate with folding movement.

In particular, the present closure structure 100 is of the type provided with hinged panels "with folding movement" (in accordance with the term employed in the jargon of the field), being provided with two or more panels hinged one after the other and rotatably movable in order to close or open the passage A, as discussed in the details hereinbelow.

Figure 1:
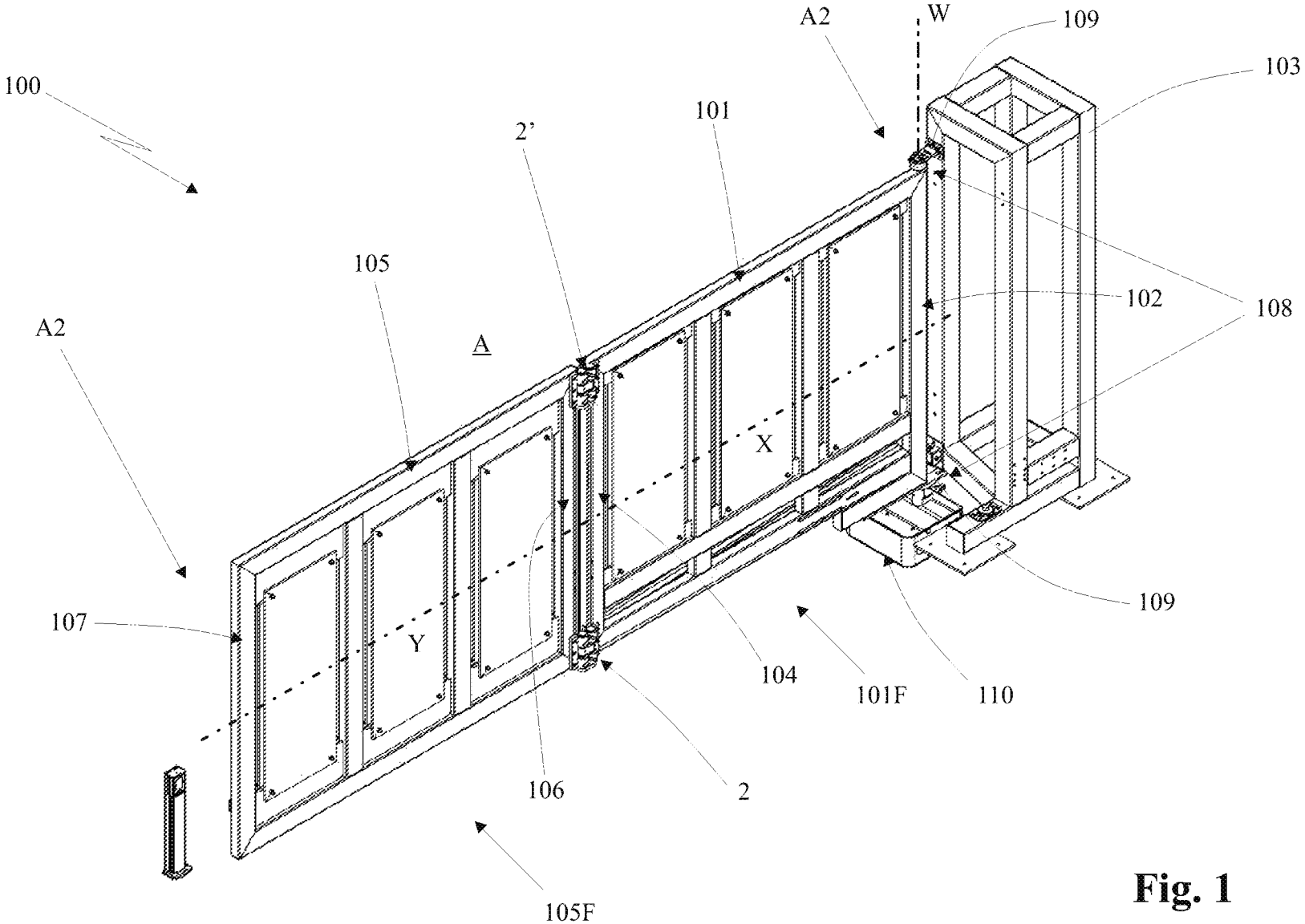
FIG. 1 shows a perspective view of a closure structure in which the present movement device is installed.
Figure 2:
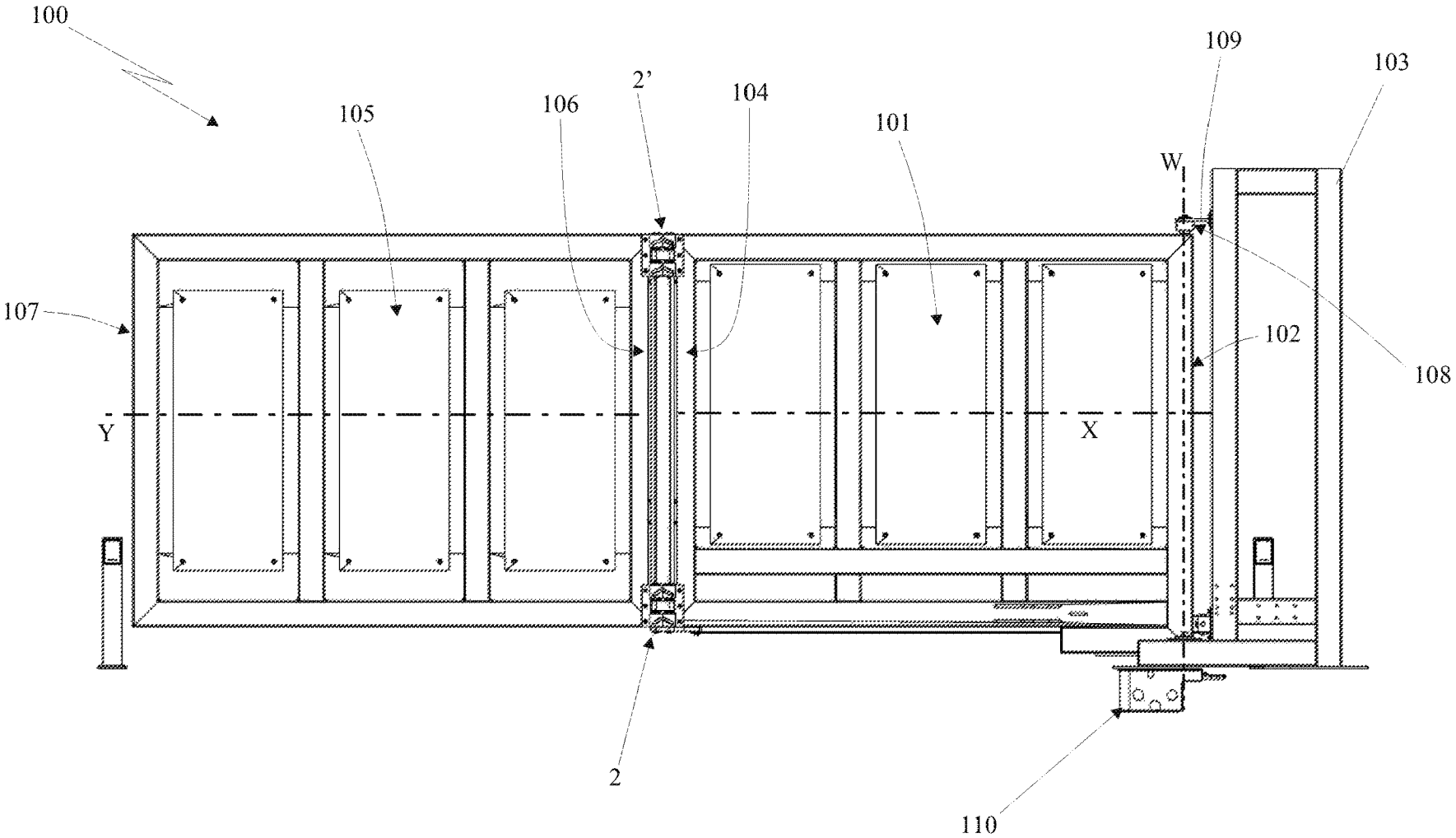
FIG. 2 shows a front view of the closure structure illustrated in FIG. 1.
Figure 3:
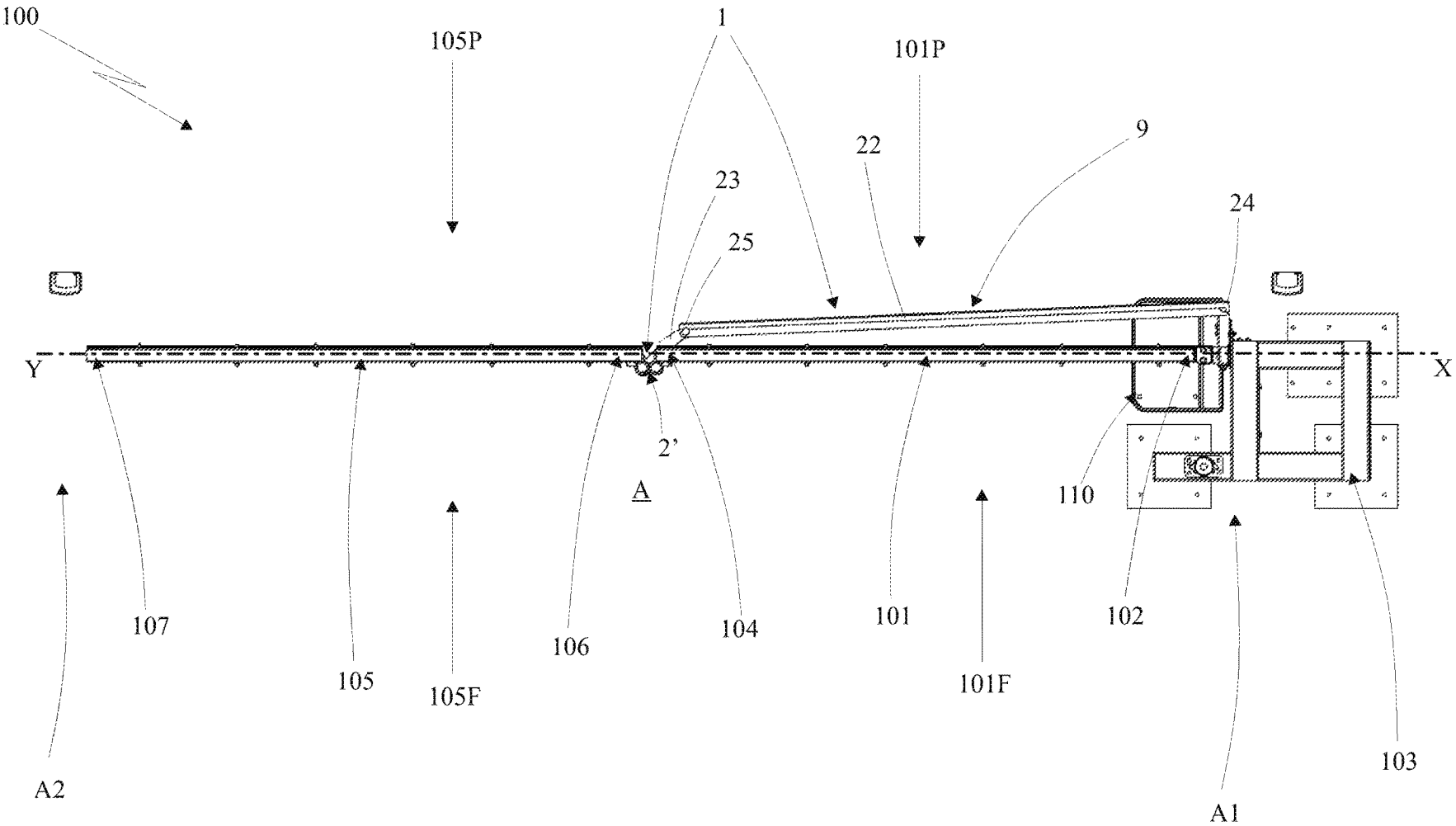
FIG. 3 shows a top plan view of the closure structure illustrated in FIG. 1.

In particular, with reference to the example of FIGS. 1-3, the passage A is extended between a first side A1 and a second side A2, each of which delimited for example by two vertical structures, such as a column or the edge of a wall.

The closure structure 100 comprises a first panel 101, which is extended along a first extension direction X (preferably substantially horizontal) between a first constrained flank 102, intended to be hinged to a support structure 103, and an opposite first free flank 104.

In particular, the aforesaid support structure 103 (to which the first panel is hinged) is arranged fixed on the first side A1 of the passage A and for example comprises a framework or a column.

In addition, the closure structure 100 comprises a second panel 105, which is extended along a second extension direction Y (parallel to the aforesaid first extension direction X of the first panel) between a second constrained flank 106, which is rotatably connected to the first free flank 104 of the first panel 101, and an opposite second free flank 107.

The two panels 101, 105 are movable for arranging the closure structure 100 between a closed position and an open position.

More in detail, in the closed position (illustrated in the example of FIGS. 1-3), the first panel 101 and the second panel 105 are arranged in succession one after the other and aligned with each other (i.e. with their extension directions X, Y aligned with each other), in a manner such to occupy the passage A, in particular with the second free edge 107 of the second panel 105 arranged at the second side A2 of the passage A.

In the open position, the first panel 101 and the second panel 105 are arranged parallel to each other and side-by-side on the first side A1 of the passage A, substantially folded as an accordion, in a manner such to leave the passage A itself free. In particular, in the movement between the closed position and the open position, the first panel 101 is substantially rotated 90° and the second panel 105 is substantially rotated 180° with respect to the first panel 101, in a manner such to be side-by-side and parallel to the latter.

Advantageously, each panel 101, 105 has a main extension along its extension direction X, Y, preferably horizontal, and is extended on an extension plane passing through such extension direction X, Y and preferably vertical.

For example, each panel 101, 105 comprises a framework, preferably metallic, provided with a lower longitudinal member and with an upper longitudinal member connected to each other by two or more uprights, and suitably closed by darkening cover panels or by gratings.

In particular, the first and the second panel 101, 105 are respectively provided with a first and with a second front side 101F, 105F and are respectively provided with an opposite first and second rear side 101P, 105P.

For example, when the closure structure 100 is in closed position, the front sides 101F, 105F of the panels 101, 105 are directed towards the outside of the zone (e.g. a property, a courtyard, a building) accessible through the passage A and the rear sides 101P, 105P are directed towards the interior of such zone.

When the closure structure 100 is in open position, the panels 101, 105 are positioned with their rear sides 101P, 105P arranged facing each other.

In addition, the closure structure 100 comprises a hinge system 108 mechanically connected to the first constrained flank 102 of the first panel 101 and intended to be mounted on the support structure 103 in order to rotatably connect the latter to the first panel 101.

The hinge system 108 is provided with a hinging axis W substantially parallel to the first constrained flank 102 of the first panel 101, and preferably substantially vertical.

In particular, the hinge system 108 comprises one or more support brackets 109 (e.g. two) fixed to the support structure 103 and carrying, rotatably mounted thereon, the first panel 101 preferably by means of corresponding ball bearings.

The closure structure 100 also comprises an actuation system 110 mechanically connected to said first panel 101 and actuatable for driving the latter to rotate around the hinging axis W (in particular by about 90°) between the open position and the closed position.

For example, the actuation system 110 comprises an embedded electric motor that is mechanically connected to the first constrained flank 102 of the first panel 101 (such as in the example of FIGS. 1-3), or an electric motor arranged on the side of the closure structure 100 and connected to the first panel 101 by means of an actuation lever, or a linear actuator hinged between the support structure 103 and the first panel 101, etc., in a manner per se known to the man skilled in the art.

The closure structure 100 comprises the movement system 1, object of the present invention, which, following the rotation of the first panel 101 driven by the actuation system 110, is adapted to drive the movement of the second panel 105 in a coordinated manner with respect to the rotation of the first panel 101, so as to arrange the closure structure 100 in the above-described open or closed positions.

The present movement system 1 comprises at least one transmission hinge 2 placed to connect between the first free flank 104 of the first panel 101 and the second constrained flank 106 of the second panel 105, in a manner such to allow the second panel 105 to complete a relative rotary motion with respect to the first free flank 104 of the first panel 101.

In accordance with the idea underlying the present invention, the transmission hinge 2 comprises, with reference to FIGS. 5-10, a first wing 4 fixed to the first free flank 104 of the first panel 101 and a second wing 5 fixed to the second constrained flank 106 of the second panel 105.

In addition, the transmission hinge 2 comprises a movement lever 6 rotatably connected to the first wing 4 around a first rotation axis R1 parallel to the hinging axis W of the hinge system 108 (which connects the first panel 101 to the support structure 103).

In addition, the second wing 5 of the transmission hinge 2 is in turn rotatably connected to the movement lever 6 around a second rotation axis R2 parallel to the aforesaid first rotation axis R1.

Preferably, the movement lever 6 is extended, in particular in a linear manner, between a first end 7, which is rotatably connected to the first wing 4 of the transmission hinge 2 at the first rotation axis R1, and a second end 8 which is rotatably connected to the second wing 5 of the transmission hinge 2 at the second rotation axis R2.

Advantageously, the movement lever 6 is arranged orthogonally to the rotation axes R1, R2, in particular substantially horizontally.

The movement system 1 comprises a motion transmission mechanism 9 (visible in detail in FIGS. 3 and 4), which is mechanically connected to the movement lever 6 of the transmission hinge 2 and is kinematically connected to the first panel 101 of the closure structure 100, in a manner such that, following the rotation of the first panel 101 around the hinging axis W, such motion transmission mechanism 9 drives the movement lever 6 to rotate around the first rotation axis R1 of the transmission hinge 2.

In addition, with reference to FIGS. 5-10, the transmission hinge 2 comprises a gear with conjugated profiles 10, which is placed to connect between the first wing 4 and the second wing 5 and is configured for transmitting a rotary motion between such wings 4, 5, in a manner such that, following the rotation of the movement lever 6 around the first rotation axis R1, the second wing 5 is actuated by such gear 10 to rotate around the second rotation axis R2 in order to make the second panel 105 rotate with respect to the first panel 101 during the movement of the closure structure 100 between the open position and the closed position.

In particular, the rotation of the movement lever 6 around the first rotation axis R1 of the first wing 4 involves a corresponding rotation of the second wing 5 (and hence of the second panel 105), around such first rotation axis R1, by a specific first movement angle. Since the second wing 5 of the transmission hinge 2 is engaged with the first wing 4 by means of the aforesaid gear with conjugated profiles 10, the relative movement between the first wing 4 and the second wing 5 determines, by means of such gear 10, a rotation of the second wing 5 around its second rotation axis R2 by a specific second movement angle, which determines a corresponding rotation of the second panel 105 around such second rotation axis R2. The first movement angle and the second movement angle are substantially supplementary, in a manner such that, in the movement between the open position and closed position, the second panel 105 completes a rotation substantially of 180° with respect to the first free flank 104 of the first panel 101.

Advantageously, the gear with conjugated profiles 10 of the transmission hinge 2 comprises a first toothed wheel 11 fixed to the first wing 4 coaxial with the first rotation axis R1 and a second toothed wheel 12 fixed to the second wing 5 coaxial with the second rotation axis R2 and engaged with the aforesaid first toothed wheel 11.

In operation, the rotation of the movement lever 6 around the first rotation axis R1 determines a corresponding rotation of the second toothed wheel 12 around the first toothed wheel 11, which, following the engagement between the two toothed wheels 11, 12, determines a rotation of the second toothed wheel 12 around the second rotation axis R2, hence determining the rotation of the second wing 5 (and thus of the second panel 105) around the second rotation axis R2 by the aforesaid second movement angle.

Advantageously, with reference to the embodiment illustrated in FIGS. 5-9, the first toothed wheel 11 and the second toothed wheel 12 are of the type with helical teeth, preferably cylindrical.

Preferably, with reference in particular to FIGS. 6-9, the second toothed wheel 12 of the transmission hinge 2 is provided with at least one helical tooth 13 extended around the second rotation axis R2, and the first toothed wheel 11 is provided with at least one corresponding helical groove 14 extended around the first rotation axis R1. The helical groove 14 of the first toothed wheel 11 has shape conjugated with that of the helical tooth 13 of the second toothed wheel 12, in a manner such that, during the rotations of the second wing 5 of the transmission hinge 2, the helical tooth 13 is progressively engaged within the helical groove 14 without generating jamming which can obstruct the rotation movement of the second wing 5 with respect to the first wing 4.

The aforesaid configuration of the toothed wheels 11, 12 with helical teeth, and in particular with the aforesaid helical tooth and groove 13, 14, ensure low noise, due to the more gradual engaging of the toothed wheels 11, 12, and a lower contact wear due to the greater contact surface area offered, given the same exchanged torque.

Of course, in an entirely equivalent manner and without departing from the protective scope of the present patent, the helical tooth 13 can be arranged on the first toothed wheel 11 and the helical groove 14 can be made on the second toothed wheel 12, or each toothed wheel 11, 12 can be provided with multiple helical teeth 13 which between them define multiple helical grooves 14 and which are engaged in corresponding helical grooves 14 of the toothed wheel 11, 12.

Advantageously, the helical groove 14 and the helical tooth 13 are extended around the corresponding rotation axis R1, R2 for an angle of at least 90° (e.g. of 120° in accordance with the particular embodiment illustrated in the enclosed FIGS. 5-9), therefore allowing the first toothed wheel 11 to determine a rotation of at least 90° of the second toothed wheel 12 around the second rotation axis R2.

In particular, a rotation of 90° of the movement lever 6 (and hence of the second wing 5) around the first rotation axis R1 determines a corresponding rotation of the second toothed wheel 12 (and hence of the second wing 5) by an angle of 90° around the second rotation axis R2, allowing obtaining the rotation of the second panel 105 (by 180° with respect to the first panel) with the toothed wheels 11, 12 having equivalent primitive diameter.

Figure 10:
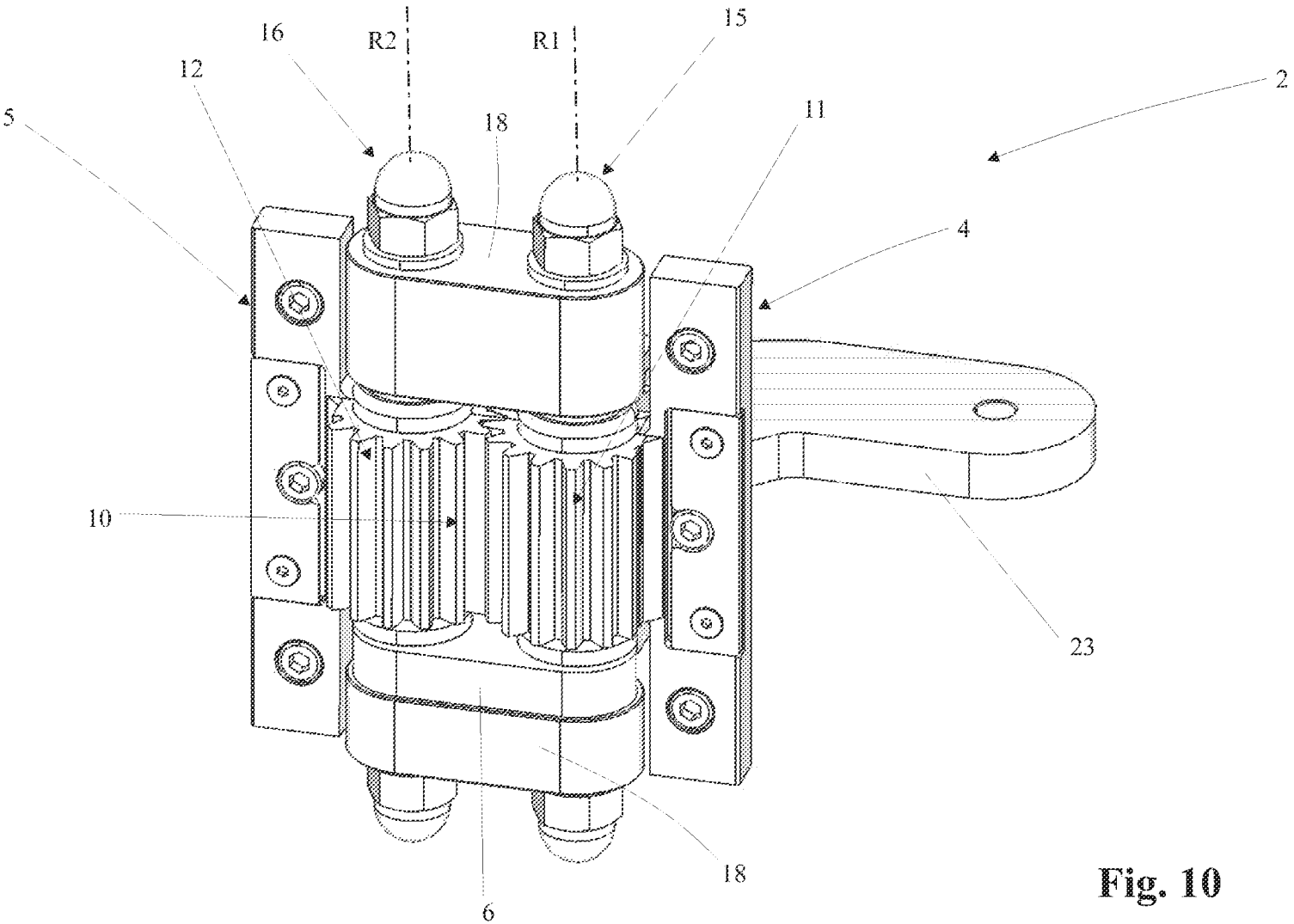
FIG. 10 shows a perspective view of the transmission hinge, according to a second embodiment of the present invention.

In accordance with a different embodiment of the present invention, the toothed wheels 11, 12 of the transmission hinge 2 are of the type with straight teeth, as showed for example in the embodiment of FIG. 10.

Figure 9:
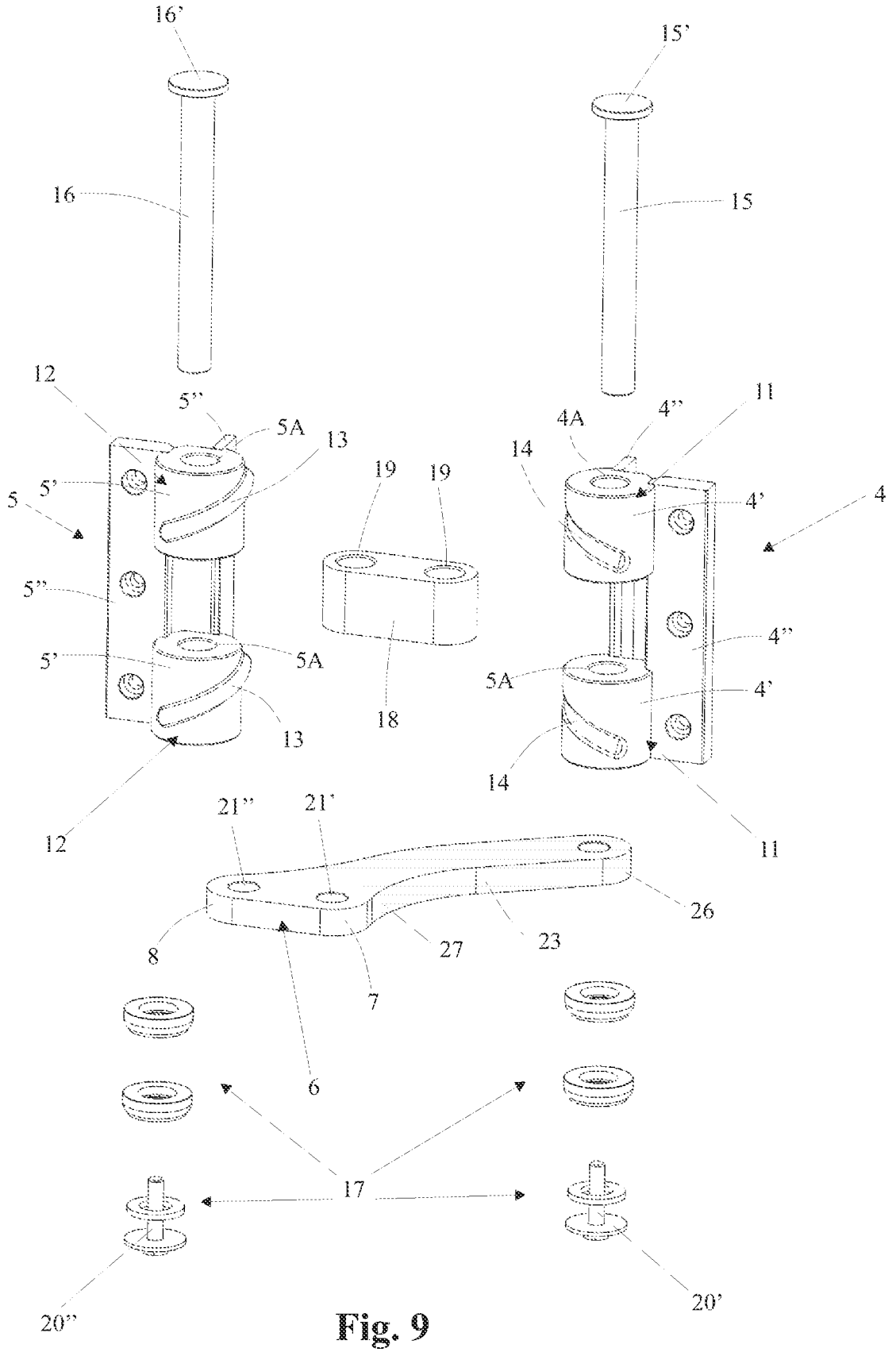
FIG. 9 shows an exploded view of the transmission hinge illustrated in FIG. 6.

Advantageously, with reference in particular to FIGS. 9 and 10, the transmission hinge 2 comprises a first pin 15 mounted on the movement lever 6 coaxial with the first rotation axis R1 and to which the first wing 4 is hinged, and a second pin 16 mounted on the movement lever 6 coaxial with the second rotation axis R2 and to which the second wing 5 is hinged.

Preferably, each wing 4, 5 of the transmission hinge 2 comprises at least one corresponding eyelet 4', 5' provided with a through hole 4A, 5A in which the corresponding pin 15, 16 is inserted, and at least one corresponding attachment portion 4", 5", in particular with plate-like shape, rigidly fixed to the corresponding eyelet 4', 5' and intended to be fixed to the corresponding panel 101, 105 of the closure structure 100 (e.g. by means of corresponding fixing screws 28', 28"). With reference to the examples illustrated in the enclosed figures, each wing 4, 5 is provided with two attachment portions 4", 5", angled 90° with respect to each other in a manner such to allow the attachment thereof at the edge of the upright of the corresponding panel 101, 105.

Preferably, the eyelets 4', 5' of the wings 4, 5 are rotatably connected to the corresponding pins 15, 16 by means of rotatable sliding arrangements 17, such as bushes and/or rolling bearings (e.g. ball bearings).

Of course, the wings 4, 5 of the transmission hinge 2 can also have shapes equivalent to that above-described particular shape, for example each pin 15, 16 can be fixed to the corresponding wing 4, 5 and be idly inserted in a pivoting hole of the movement lever 6, and/or the attachment portions 4", 5" of the wings 4, 5 can also have shapes that are not plate-like.

Preferably, the toothed wheels 11, 12 of the transmission hinge 2, and in particular the helical tooth 13 and the helical groove 14, are made on the external surface of the eyelets 4', 5' of the corresponding wings 4, 5.

Advantageously, the transmission hinge 2 comprises a retention plate 18 placed as a rotatable connection between the first pin 15 and the second pin 16, in a manner such that the first wing 4 and the second wing 5 are arranged (according to a direction parallel to their rotation axes R1, R2) between the movement lever 6 and such retention plate 18. The interposition of the two wings 4, 5 between the movement lever 6 and the retention plate 18 allows the latter to compensate for the axial component (parallel to the rotation axes R1, R2) of the thrust forces exerted between helical teeth of the toothed wheels 11, 12, therefore preventing possible movements of the second panel 105 parallel to the rotation axes R1, R2.

Preferably, the retention plate 18 is provided with two through insertion holes 19 in which the corresponding pins 15, 16 of the transmission hinge 2 are idly inserted.

Advantageously, the first wing 4 and the second wing 5 of the transmission hinge 2 are respectively provided with multiple first toothed wheels 11 arranged in succession along the first rotation axis R1 and with multiple second toothed wheels 12 arranged in succession along the second rotation axis R2, in which each first toothed wheel 11 of the first wing 4 is engaged with the corresponding second toothed wheel 12 of the second wing 5.

In accordance with the particular embodiment illustrated in FIGS. 5-9, each wing 4, 5 is provided with two corresponding toothed wheels 11, 12 spaced from each other by the retention plate 18 and axially constrained between a head 15', 16' of the corresponding pin 15, 16 and a retention screw 20', 20" inserted in a corresponding passage hole 21', 21" of the movement lever 6 and engaged with the aforesaid corresponding pin 15, 16.

Advantageously, the motion transmission mechanism 9 of the movement system 1 is of connecting rod-crank type and is kinematically connected to the first panel 101 in a manner such to define, with the latter, an articulated quadrilateral.

Figure 4:
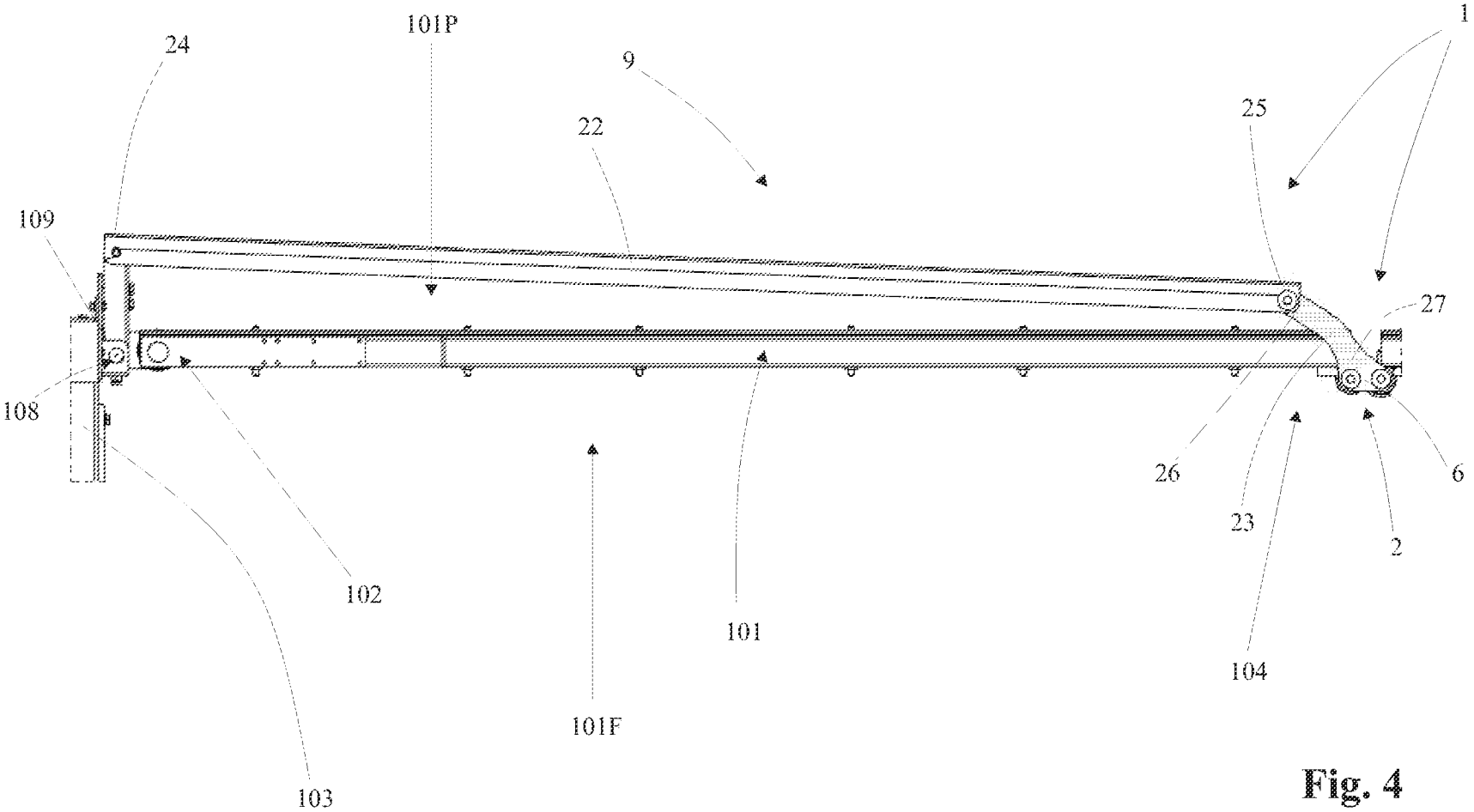
FIG. 4 shows a bottom view of a detail of the closure structure, relative to a first panel and to a motion transmission system of the movement system.
Figure 5:
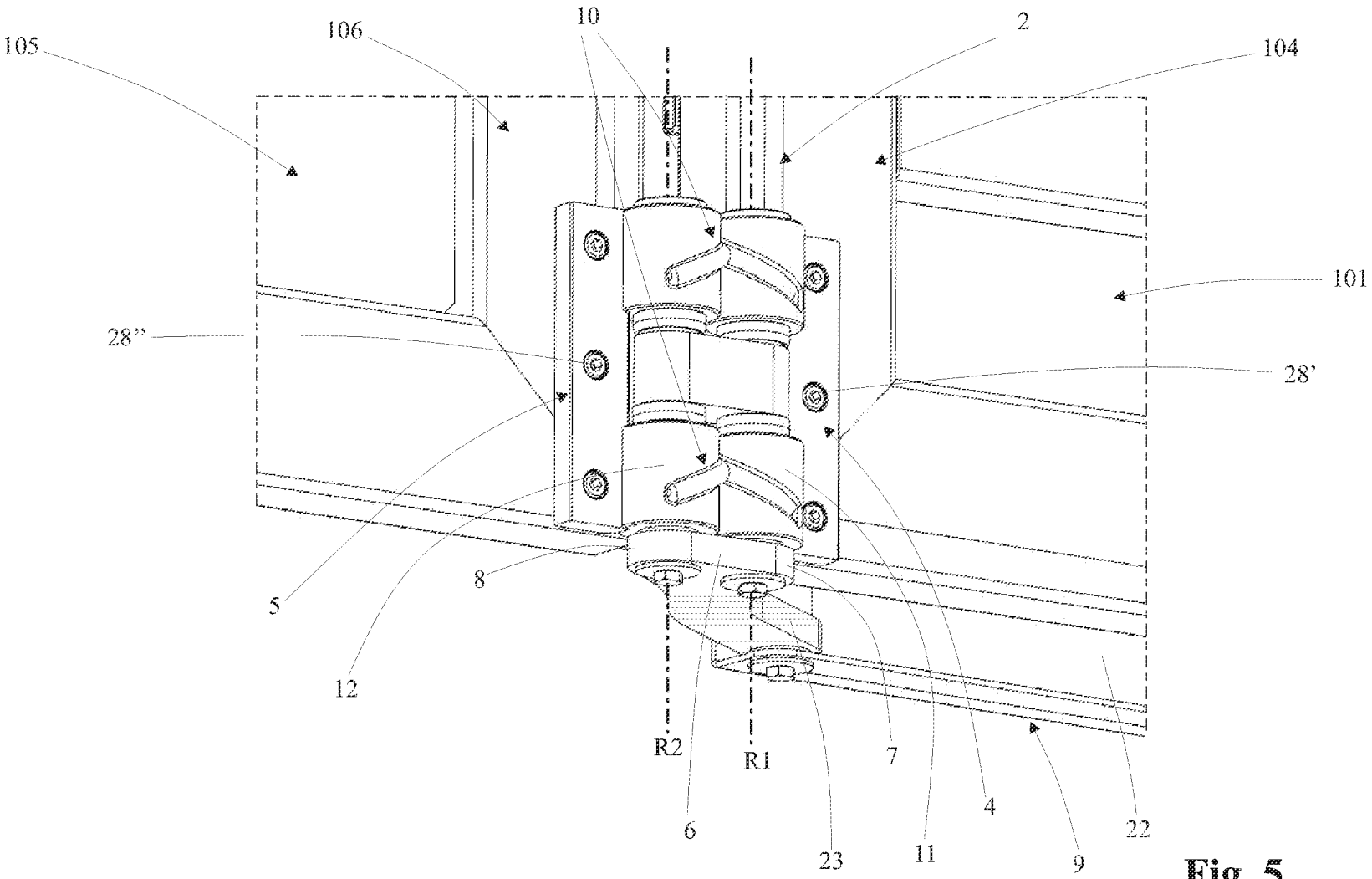
FIG. 5 shows a perspective view of a detail of the movement system relative to a transmission hinge mounted to connect between the first panel and the second panel of the closure structure, according to a first embodiment of the present invention.
Figure 6:
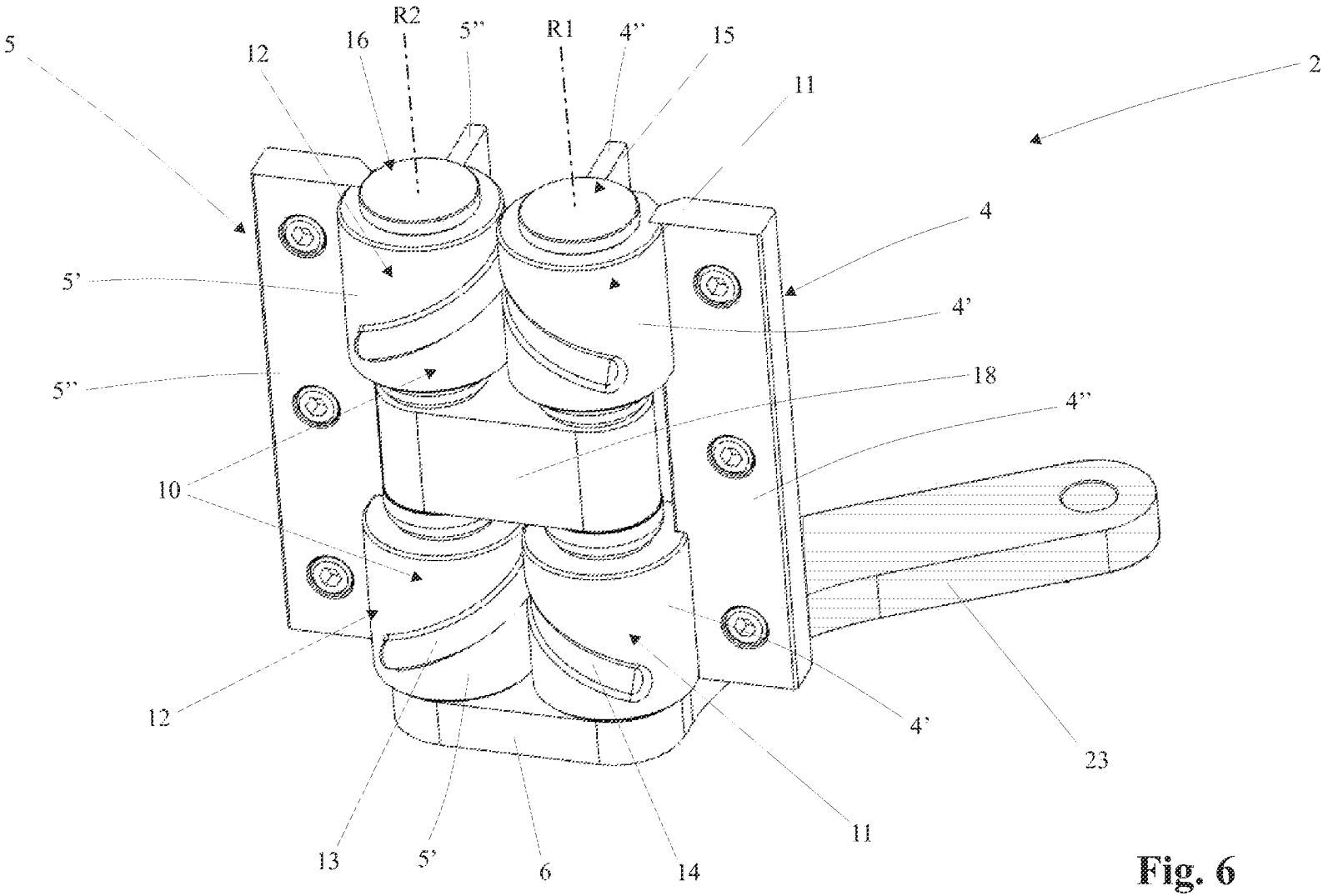
FIG. 6 shows a further perspective view of the transmission hinge of FIG. 5, in which the other parts of the closure structure have been removed.
Figure 7:
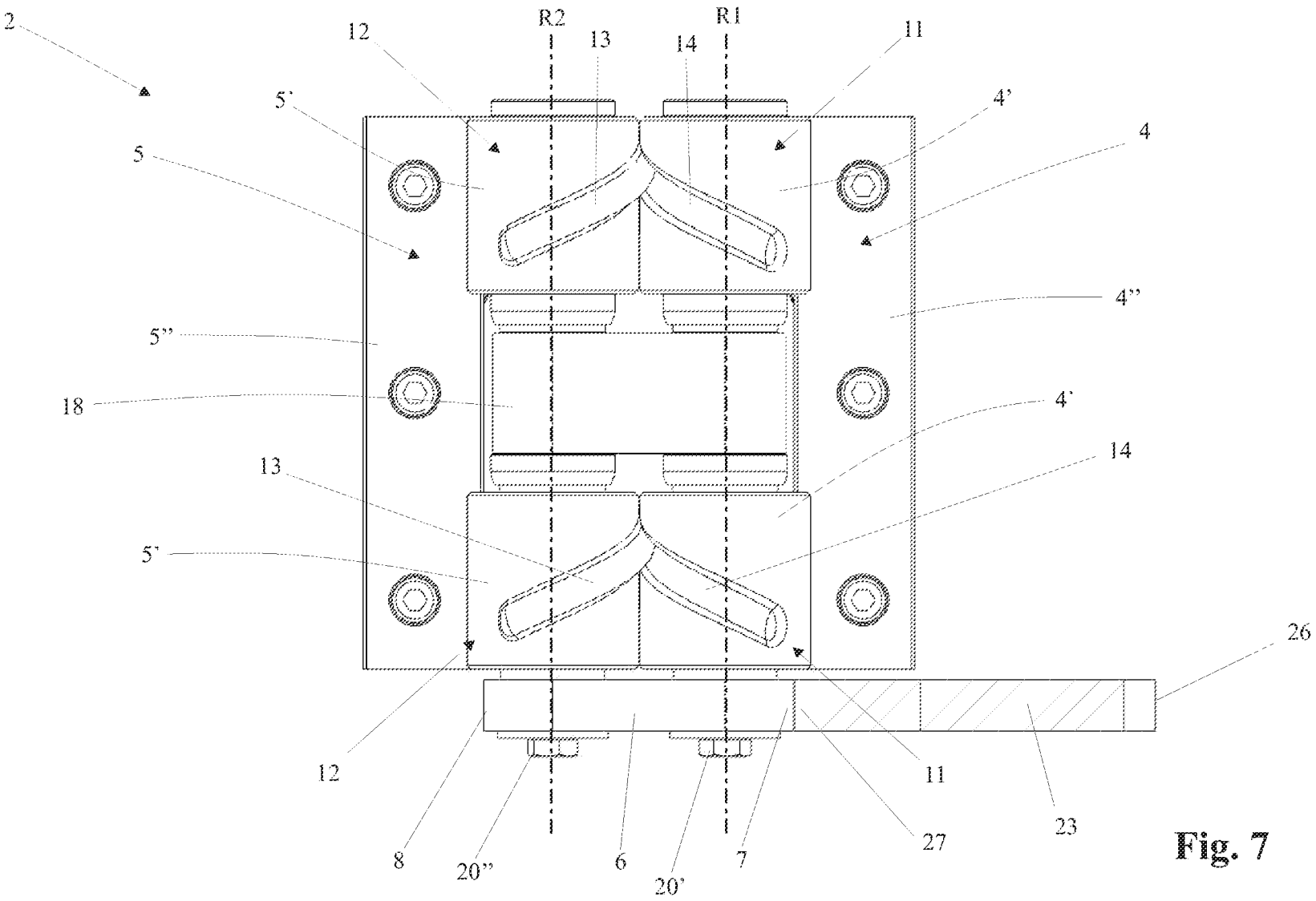
FIG. 7 shows a front view of the transmission hinge illustrated in FIG. 6.
Figure 8:
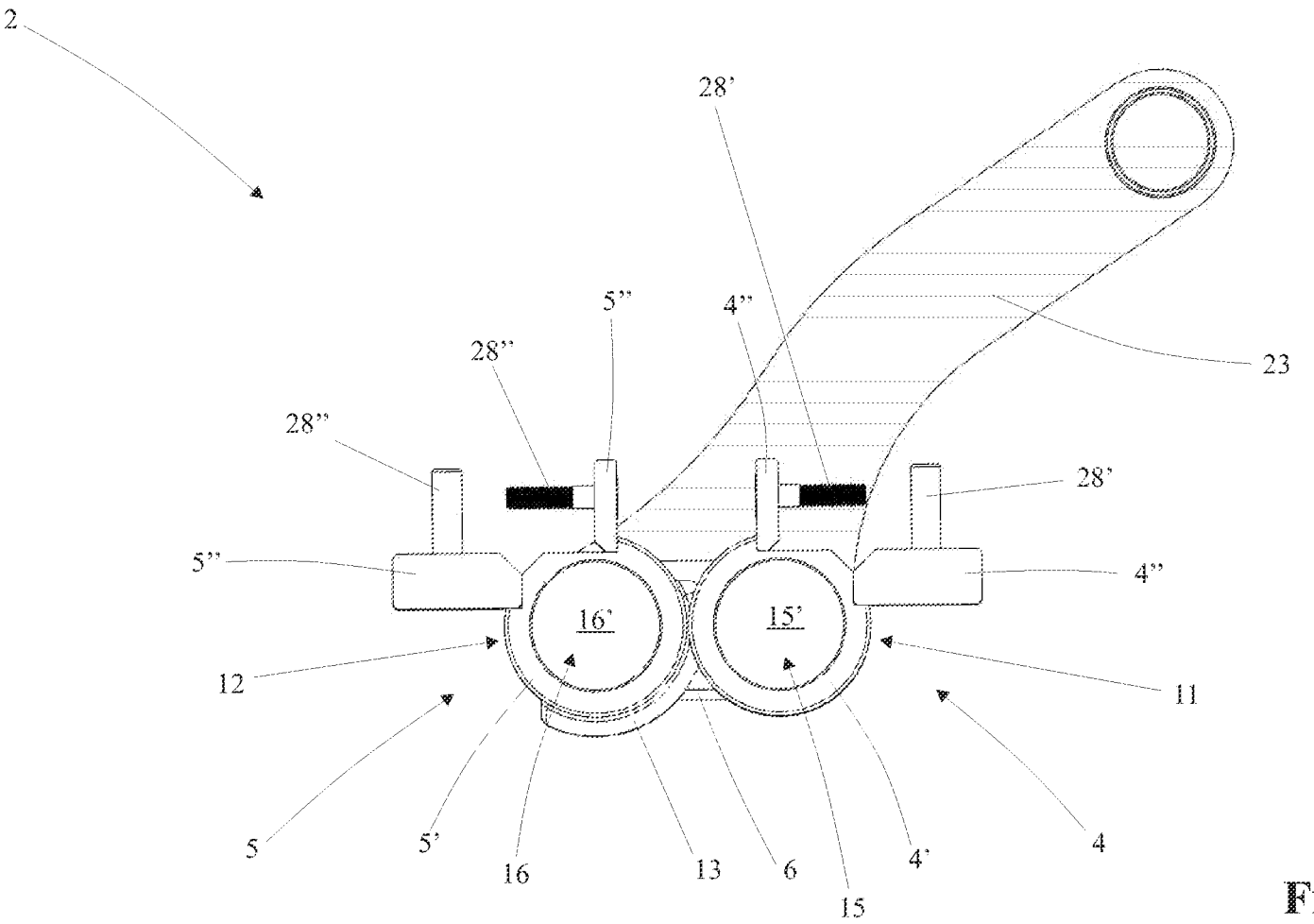
FIG. 8 shows a top plan view of the transmission hinge illustrated in FIG. 6.

More in detail, with reference to FIGS. 3 and 4, the motion transmission mechanism 9 comprises a crank 22 intended to be rotatably connected to the support structure 103, and a connecting rod 23 rotatably connected to the crank 22 and fixed to the movement lever 6. In this manner, the crank 22 and the connecting rod 23 define an articulated quadrilateral in which the other connecting rod is the first panel 101 with the support structure 103 that acts as fixed frame.

Preferably, the crank 22 is extended between a first end 24 intended to be hinged to the support structure 103 and a second end 25 hinged to the connecting rod 23. The latter is extended between a third end 26 hinged to the second end 25 of the crank 22 and a fourth end 27 rigidly fixed to the movement lever 6 (e.g. integral with the latter).

Suitably, the connections of the crank 22 and of the connecting rod 23 are obtained by means of rotational torques with axes parallel to the rotation axes R1, R2 of the transmission hinge 2.

Preferably, the motion transmission mechanism 9 is arranged on the first rear side 101P of the first panel 101 and the transmission hinge 2 is mounted at the front sides 101F, 105F of the panels 101, 105.

In operation, in the passage from the closed position to the open position, the actuation system 110 drives the first panel 101 to rotate around the hinging axis W towards its first rear side 101P. Such movement of the first panel 101 ensures that the crank 22 of the motion transmission mechanism 9 brings its second end 25 towards the first free flank 104 of the first panel 101, making the connecting rod 23 (and the movement lever 6 fixed thereto) rotate around the first rotation axis R1 of the transmission hinge 2 towards the front sides 101F, 105F of the panels 101, 105, causing the rotation of the second panel 105 by the aforesaid first movement angle. The engagement between the toothed wheels 11, 12 of the transmission hinge 2 determines the rotation of the second panel 105 around the second rotation axis R2 (as described in detail above), always towards the first front side 101F of the first panel 101, in a manner such to arrange the second front side 105F of the second panel 105 facing across from the first front side 101F of the first panel 101 in the closed position.

In an analogous manner, the movement system 1 determines the movement of the panels 101, 105 in the passage from the open position to the closed position, with directions of the movements opposite those described above for the reverse displacement of the closure structure 100.

Preferably, when the closure structure 100 is in closed position, the movement lever 6 is substantially aligned (according to its extension between the first and the second end 7, 8) with the extension directions X, Y of the panels 101, 105. When the closure structure 100 is in open position, the movement lever 6 is orthogonal to the first extension direction X of the first panel 101, and the second extension direction Y of the second panel 105 is orthogonal to the movement lever 6, in a manner such that the second panel 105 is parallel to and side-by-side the first panel 101.

Suitably, the components of the movement system 1 (in particular the components of the transmission hinge 2 and of the motion transmission mechanism 9) are made of rigid material, preferably metal such as steel.

In accordance with the embodiment illustrated in FIGS. 1-3, the transmission hinge of the movement system 1 is preferably arranged at the lower longitudinal members of the panels 101, 105.

Advantageously, the movement system 1 comprises at least one auxiliary hinge 2', placed for example at the upper longitudinal members of the panels 101, 105, in order to maintain the second panel 105 rotatably aligned. Preferably, the aforesaid auxiliary hinge 2' has a structure analogous to that of the transmission hinge 2 (in particular with two wings 4, 5 rotatable around the two rotation axes R1, R2 and with a gear with conjugated profiles 10 in particular constituted by toothed wheels 11, 12), in which the movement lever 6 is not directly connected to the motion transmission mechanism 9. In accordance with a different embodiment not illustrated in the enclosed figures, the auxiliary hinge 2' may lack the gear with conjugated profiles 10, while maintaining the remaining structural characteristics.

Of course, without departing from the protective scope of the present patent, the movement system 1 can comprise multiple transmission hinges 2 and/or multiple auxiliary hinges 2'.

In accordance with the embodiment illustrated in the enclosed figures, the closure structure 100 has a movement from a single side, i.e. from the first side A1 of the passage A at which the first panel 101 is hinged. Of course, without departing from the protective scope of the present invention, the closure structure 100 can also have a movement from both sides A1, A2 of the passage A, in which for example the single-side configuration is symmetrically repeated on the second side A2 of the passage A, in a manner such that, when the closure structure 100 is in closed position, the second free flanks 107 of the second panels 105 meet at the center of the passage A.

Of course, the object of the present invention can also be applied to a folding closure structure provided with more than two panels hinged in succession. In such case, the movement system 1 is repeated between the second panel and a third panel, and so forth if further panels are provided for.

The invention thus conceived therefore attains the pre-established objects.

The disclosures in the Italian patent application n. 102019000000301, from which this application claims priority, are incorporated herein by reference.

The invention claimed is:

1. A movement system for a closure structure with folding movement, wherein said closure structure comprises:

a first panel, which is extended along a first extension direction between a first constrained flank, which is hinged to a support structure around a hinging axis, and a first free flank;

a second panel, which is extended along a second extension direction between a second constrained flank, which is rotatably connected to the first free flank of said first panel, and a second free flank;

wherein said movement system comprises a transmission hinge intended to be placed to connect between the first free flank of said first panel and the second constrained flank of said second panel;

wherein said transmission hinge comprises:

a first wing intended to be fixed to the first free flank of said first panel;

a movement lever hinged to said first wing around a first rotation axis;

a second wing, which is hinged to said movement lever around a second rotation axis parallel to said first rotation axis, and is intended to be fixed to the second constrained flank of said second panel;

wherein said movement system also comprises a motion transmission mechanism, which is mechanically connected to said movement lever and is intended to be kinematically connected to said first panel, in a manner such that, following the rotation of said first panel around said hinging axis, said motion transmission mechanism drives said movement lever to rotate around said first rotation axis;

wherein said transmission hinge comprises a gear with conjugated profiles, which is placed to connect between said first wing and said second wing and is configured for transmitting a rotary motion between said first wing and said second wing, in a manner such that, following the rotation of said movement lever around said first rotation axis, said second wing is actuated by said gear with conjugated profiles to rotate around said second rotation axis.

2. The movement system of claim 1, wherein said gear with conjugated profiles comprises:

a first toothed wheel, which is fixed to said first wing, and is coaxial with said first rotation axis;

a second toothed wheel, which is fixed to said second wing, is coaxial with said second rotation axis, and is engaged with said first toothed wheel.

3. The movement system of claim 2, wherein said first toothed wheel and said second toothed wheel have helical teeth.

4. The movement system of claim 3, wherein one of said first toothed wheel and second toothed wheel is provided with at least one helical tooth extended around the corresponding rotation axis, and the other of said first toothed wheel and second toothed wheel is provided with a helical groove extended around the corresponding rotation axis and having shape conjugated with that of said helical tooth.

5. The movement system of claim 4, wherein said helical tooth and said helical groove are extended around the corresponding rotation axis for an angle of at least 90°.

6. The movement system of claim 1, wherein said transmission hinge comprises:

a first pin, which is mounted on said movement lever and is coaxial with said first rotation axis, wherein said first wing is hinged to said first pin;

a second pin, which is mounted on said movement lever and coaxial with said second rotation axis, wherein said second wing is hinged to said second pin.

7. The movement system of claim 6, wherein said transmission hinge comprises a retention plate placed as a rotatable connection between said first pin and said second pin, wherein said first wing and said second wing are rotatably retained between said movement lever and said retention plate.

8. The movement system of claim 1, wherein said motion transmission mechanism comprises:

a crank intended to be rotatably connected to said support structure;

a connecting rod rotatably connected to said crank and fixed to said movement lever.

9. The movement system of claim 2, wherein said first toothed wheel and said second toothed wheel have straight teeth.

10. A closure structure with folding movement, comprising:

said first panel (101), which is extended along said first extension direction between said first constrained flank and said first free flank;

a hinge system, which is provided with said hinging axis, is mechanically connected to the first constrained flank of said first panel, and is intended to be mounted on said support structure in order to rotatably connect said first panel to said support structure around said hinging axis;

said second panel, which is extended along said second extension direction between said second constrained flank, which is rotatably connected to the first free flank of said first panel, and said second free flank;

an actuation system, which is mechanically connected to said first panel and is actuatable for driving said first panel to rotate around said hinging axis;

the movement system of claim 1, wherein the first wing of said transmission hinge is fixed to the first free flank of said first panel, and the second wing of said transmission hinge is fixed to the second constrained flank of said second panel.

11. The closure structure of claim 10, wherein said actuation system is configured for moving said closure structure between a closed position, in which said first panel and said second panel are arranged in succession one after the other and aligned according to said first extension directions and said second extension axis to close a passage, and an open position, in which said first panel and said second panel are arranged parallel to each other and side-by-side on one side of said passage;

wherein:

with said closure structure in said closed position, said movement lever is substantially aligned with said first extension directions and said second extension axis, with said closure structure in said open position, said movement lever is orthogonal to the first extension direction of said first panel, and the second extension direction of said second panel is orthogonal to said movement lever.

* * * * *